US008827406B1

(12) United States Patent
de Jong et al.

(10) Patent No.: US 8,827,406 B1
(45) Date of Patent: Sep. 9, 2014

(54) MOTION QUALITY OF A TRANSFIX NIP BY MEDIA THICKNESS AND/OR SKEW FEEDFORWARD TO NIP MOTOR TORQUE

(71) Applicant: Xerox Corporation, Norwalk, CT (US)

(72) Inventors: Joannes N. M. de Jong, Hopewell Junction, NY (US); Barry P. Mandel, Fairport, NY (US)

( * ) Notice: Subject to any disclaimer, the term of this patent is extended or adjusted under 35 U.S.C. 154(b) by 0 days.

(21) Appl. No.: 13/836,433

(22) Filed: Mar. 15, 2013

(51) Int. Cl.
*B41J 29/38* (2006.01)
*B41J 13/00* (2006.01)

(52) U.S. Cl.
CPC ..... *B41J 13/0009* (2013.01)
USPC ..... 347/16; 347/14; 347/104

(58) Field of Classification Search
USPC ..... 347/9, 14, 16, 101, 104, 105
See application file for complete search history.

(56) References Cited

U.S. PATENT DOCUMENTS 6,731,891 B1 5/2004 Calamita et al.
6,860,201 B2 * 3/2005 Guillen et al. ..... 101/228
6,934,504 B2 * 8/2005 Morita ..... 399/394
6,991,387 B2 1/2006 Kida
7,063,318 B2 6/2006 Jacobs et al.
7,065,308 B2 6/2006 Calamita et al.
7,243,917 B2 7/2007 Knierim et al.
7,422,211 B2 9/2008 DeJong et al.
7,523,933 B2 4/2009 Linder et al.
7,578,503 B2 8/2009 McLaughlin et al.
7,731,188 B2 6/2010 deJong et al.
7,806,404 B2 10/2010 deJong et al.
7,971,878 B2 7/2011 Hashimoto et al.

FOREIGN PATENT DOCUMENTS

JP 2007-84209 A * 4/2007

* cited by examiner

*Primary Examiner* — Juanita D Jackson

(57) ABSTRACT

Embodiments described herein are directed to a system for reducing velocity transits in a printing system caused by media entering into a transfer nip. The system includes: an imaging drum, a variable speed motor, a transfix roll, a transfix nip, a media transport, a thickness sensor, a skew sensor, a media sensor, a switching means and a controller. Media thickness and/or media skew measurements are used in a feedforward control scheme to increase the imaging drum torque when the media sensor detects a media immediately before it is engaged by the transfer nip.

20 Claims, 9 Drawing Sheets

MOTION QUALITY OF A TRANSFIX NIP BY MEDIA THICKNESS AND/OR SKEW FEEDFORWARD TO NIP MOTOR TORQUE

BACKGROUND

1. Technical Field

The presently disclosed technologies are directed to a system and method for reducing print quality defects due to excursions in the velocity of media transport caused by a transfix nip in a direct marking printing system. The system and method described herein use sensors to measure the media thickness and/or skew to adjust the transport speed and decrease potential print quality defects.

2. Brief Discussion of Related Art

In order to ensure good print quality in direct marking printing systems, the velocity of the media transported through the printing system must remain at a predetermined rate. Typically, a printing system is designed for media with a specific thickness. The design anticipates the change in velocity that occurs as the media is transported through the system and compensates for them. However, when media having a different thickness is used, the transport velocity can increase or decrease and can cause print quality defects.

A conventional transfix nip consists of an imaging drum and a transfix roll which is preloaded against the imaging drum. Media entering this nip cause a velocity transient which results in a degradation of image quality. U.S. Pat. No. 7,065,308 describes a system to reduce velocity transients using feed forward torque control to a nip motor. When the media enters the nip, the motor speed changes based on media characteristics obtained from table entries. This requires a priori knowledge and is also subject to operator error when specifying the correct media type. These errors can result in a compromised capability of the feedforward control and resulting image degradation.

The prior art includes various methods for reducing motion disturbances caused by feeding sheets into a transfix nip. The nip is formed between an imaging drum and a transfix roll under a pre-load which forces them together. Both the imaging roll and the transfix roll are driven by a servo motor. Sheets are fed into the nip causing motion disturbances. One method in the prior art for reducing motion disturbances supplies a supplemental (i.e., feedforward) torque profile to the transfix roll upon sheet arrival at the interface. A table based upon the media characteristics is used to determine the transfer roll drive current that must be supplied to increase and decrease the imaging drum rotational velocity in order to maintain a substantially constant imaging drum rotational velocity.

One prior art method reduces the torque disturbance of the lead and trail edge of a sheet by applying a supplementary (i.e., feedforward) torque profile to the imaging drum when the sheet arrives or leaves the nip formed by the imaging drum/transfix interface. Another prior art method uses the effect of skew to reduce the velocity transient. In this method, the transfix roll is skewed relative to the imaging drum. This is similar to the method that has no skew between the imaging drum and the transfix roll but the media entering the nip is skewed. Still another method measures the sheet entry torque spike at an upstream media path nip to control the torque supplied to a downstream media path nip to counter-act "thump"—the velocity transient resulting from the nip roller engaging the sheet. Accordingly, there is a need for a system and a method that reduces the velocity transient caused when the nip roller engages the media.

SUMMARY

According to aspects described herein, there is disclosed a system for reducing velocity transits in a printing system caused by media entering into a transfer nip. The system includes: an imaging drum, a variable speed motor, a transfix roll, a transfix nip, a media transport, a means for determining media thickness (such as a thickness sensor), a skew sensor, a media sensor, an electronic switching control means and a controller.

The imaging drum rotates about a longitudinal axis and has a drum surface equidistant from the longitudinal axis. The transfix roll rotates about a longitudinal axis at an angular velocity and has a roll surface equidistant from the longitudinal axis. The longitudinal axis of the drum is substantially parallel to the longitudinal axis of the roll and the drum surface contacts the roll surface. The variable speed motor rotates the imaging drum at an angular velocity. The angular velocity of the imaging drum is adjusted based on the thickness output signal and the skew output signal. The variable speed motor includes a speed sensor for measuring the angular velocity and transmitting a motor speed output signal. The adjustment of the controller output based on the thickness output signal and/or the skew output signal maintains the angular velocity of the drum at the motor speed set point when the thickness of the media changes.

The transfix nip is formed where the imaging drum contacts the transfix roll. The media entering into the transfix nip causes a velocity transient in the angular velocity of the imaging drum. The media transport moves a media along a media path in a process direction to the transfix nip. The transfix nip can receive media having a thickness of from 50 μm to 2 mm, preferably from 100 μm to 1 mm and most preferably from 100 μm to 500 μm.

The system also includes a media thickness torque profile for media of different thicknesses and a media skew torque profile for media of different skews. The means for determining the thickness (e.g., a thickness sensor) measures the thickness of the media and transmits a thickness output signal. The thickness output signal is compared to the media thickness torque profile to provide a media thickness torque value. The skew sensor measures the skew of the media and transmits a skew output signal. The skew output signal is compared to the media skew torque profile to provide a media skew torque value. The media thickness torque value and/or the media skew torque value are used to calculate a torque compensation signal (also referred to herein as a velocity transient compensation signal) to increase the seed of the variable speed motor. The velocity transient compensation is equal to within +/−30%, preferably +/−20% and most preferably +/−10% of the velocity transient in the angular velocity.

The media sensor detects media entering into the transfix nip. When the media sensor detects media, it initiates the feedforward control to just the motor speed based on the media thickness torque value and/or the media skew torque value. The controller has a motor speed set point and an output signal that controls the variable speed motor at the motor speed set point. The motor speed is adjusted based on the motor speed output signal. The electronic switching control means has an on state and an off state. When the switch is in the on state, the thickness and skew output signals adjust the controller output signal. When the switch is in the off state, the thickness and skew output signals do not adjust the controller output signal.

DETAILED DESCRIPTION

Figure 1:
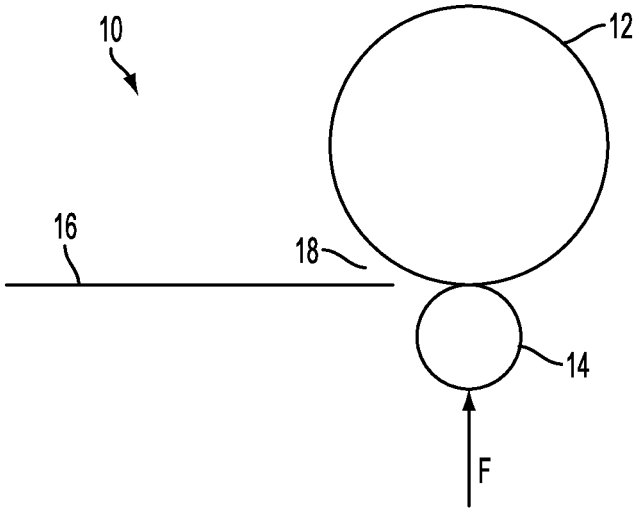
FIG. 1 PRIOR ART
FIG. 1 depicts a direct marking printing system that is known in the prior art.

The exemplary embodiments for the system for reducing velocity transits in a printing system caused by media entering into a transfer nip are now discussed in further detail with reference to the figures.

As used herein, "substrate media" and "media" refer to a tangible medium, such as paper (e.g., a sheet of paper, a ream of paper, etc.), transparencies, parchment, film, fabric, plastic, photo-finishing papers or other coated or non-coated substrates on which information or on an image can be printed, disposed or reproduced. While specific reference herein is made to a sheet or paper, it should be understood that any substrate media in the form of a sheet amounts to a reasonable equivalent thereto As used herein, "ink" and "toner" refer to matter used to form images on a belt and/or substrate media. While ink is generally stored in a liquid form and toner is generally stored in a solid form, ink and/or toner can be stored in various forms. For example, ink can be stored in a liquid form or a solid form. The term ink is used generally herein to mean either ink or toner.

As used herein, a "printing system" refers to a device, machine, apparatus, and the like, for forming images on substrate media using ink, toner, and the like, and a "multi-color printing system" refers to a printing system that uses more than one color (e.g., red, blue, green, black, cyan, magenta, yellow, clear, etc.) ink or toner to form an image on substrate media. A "printing system" can encompass any apparatus, such as a printer, digital copier, bookmaking machine, facsimile machine, multi-function machine, etc. which performs a print outputting function. Some examples of printing systems include Direct-to-Paper (e.g., Direct Marking), modular overprint press (MOP), ink jet, solid ink, as well as other printing systems.

As used herein, a "direct marking printing system" or "direct-to-paper printing system," refers to a printing system in which ink is disposed directly to substrate media as opposed to building an image on an intermediate transfer belt or drum and subsequently transferring the image to the substrate media.

As used herein, an "image" refers to a visual representation, reproduction, or replica of something, such as a visual representation, reproduction, or replica of the contents of a computer file rendered visually by a printing system. An image can include, but is not limited to: text; graphics; photographs; patterns; pictures; combinations of text, graphics, photographs, and patterns; and the like.

As used herein, a "media transport unit" refers to an apparatus that transports substrate media passed a print station in a printing system. Some examples of media transport units include a media transport belt and a rotating media drum.

As used herein, "transfer roll" or "transfer roll" refers to the roller that transfers the toner particles from the drum to the paper.

As used herein, "imaging drum" refers to is a positively charged cylinder that transfers an image or text to a piece of paper that passes under it through a series of negative and positive electrical charges.

As used herein, "transfer nip" or "transfer nip" or "nip" refers to the point where the surfaces of an imaging drum and a roller or two rollers converge and receive a sheet of media in a direct marking printing system.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as referred to herein can include one or more point sensors and/or array sensors for detecting and/or measuring characteristics or parameters in a printing system, such as substrate media location, position, speed, orientation, process or cross-process position, and the like.

As used herein, "detecting" refers to identifying, discovering, or recognizing the presence or lack thereof of an object or thing, such as the presence of substrate media.

As used herein, a "roller" refers to a nip or cam that guides and/or transports substrate media in the process direction through a printing system.

As used herein, "skewed" refers to a position of an object or thing with respect to a reference line or surface where the object or thing is neither perpendicular nor parallel to the reference line or surface. For example, substrate media can be skewed when a leading edge of substrate media is not substantially parallel to a cross-process direction.

As used herein, "process direction" refers to a direction in which substrate media is processed through a printing device and "cross-process direction" or "lateral" refers to a direction substantially perpendicular to the process direction.

As used herein, "lateral position" refers to a position of an object or thing in the cross-process direction.

As used herein, "downstream" refers to location of an object relative to a location of another object based on the process direction, wherein an object is downstream from another object when it is located away from the other object in the process direction.

As used herein, "upstream" refers to location of an object relative to a location of another object based on the process direction, wherein an object is upstream from another object when it is located away from the other object in a direction that is opposite to the process direction.

As used herein, a "lead edge" refers to an edge of the substrate media that is further downstream than the remainder of the substrate media.

As used herein, "transporting" refers to carrying and/or moving an object or thing, such as an image or substrate media, from location to another location.

As used herein, "align" refers to adjusting to a desired, intended, expected, or specified position.

As used herein, "position" or "location" refers to a location of one object or thing with respect to another object or thing, such as for example, a location of substrate media with respect to a print head and/or with respect to an inboard or outboard side of a media transport unit.

As used herein, "fixed" refers to constrained, set in place, not readily moveable, and the like.

As used herein, "compensate" refers to offsetting, adjusting, or correcting the registration errors.

As used herein, a "controller" refers to a processing device for executing commands or instructions for controlling one or more components of a printing system and/or performing one or more processes implemented by the printing system.

As used herein, "moment of inertia" refers to the tendency of a body to resist angular acceleration, expressed as the sum of the products of the mass of each particle in the body and the square of its perpendicular distance from the axis of rotation.

As used herein, the term "thump" refers to the change in torque of the motor (also referred to herein as "the velocity transient") operating the imaging drum when a substrate media is nipped.

As used herein, the terms "process" and "process direction" refer to a direction for a process of moving, transporting and/or handling a substrate media. The process direction substantially coincides with a direction of a flow path P along which the substrate media is primarily moved within the media handling assembly. Such a flow path P is the flow from upstream to downstream. A "lateral direction" or "cross-process direction" are used interchangeably herein and refer to at least one of two directions that generally extend sideways relative to the process direction. From the reference of a sheet handled in the process path, an axis extending through the two opposed side edges of the sheet and extending perpendicular to the process direction is considered to extend along a lateral or cross-process direction.

As used herein, the term "media thickness torque profile" refers to curves representing the change in motor torque applied when a transfix nip engaged media having different thicknesses.

As used herein, the term "media skew torque profile" refers to curves representing the change in motor torque applied when a transfix nip engaged media having different skews.

Exemplary embodiments included are directed to a system for reducing velocity transits caused by media entering into a transfer nip.

The system and method described herein reduces the velocity transient (also referred to herein interchangeably as "thump") caused by media entering into a transfix nip. The system uses a feedforward torque control system that is based on a measurement of media thickness and/or a measurement of media skew. The magnitude of the velocity transients is a strong function of media thickness. Therefore, using sensors to measure media thickness and a feedforward control system (i.e., a controller) that uses this measurement to adjust the torque profile significantly reduces velocity transients with resulting improvement in image quality. It has also been shown that the velocity transient is a function of media skew. Hence, a skew measurement can also be used in a similar manner to optimize the feed forward signal and reduce the velocity transient.

Referring now to the drawings, FIG. 1 shows a prior art printing system 10 with an imaging drum 12 and a transfix roller 14. A force (F) on the roller 14 maintains contact between the imaging drum 12 and the transfix roller 14. A media substrate 16 is fed into the transfix nip 18 between the imaging drum 12 and the transfix roller 14. The media substrate 16 decreases the velocity of the imaging drum 12 by increasing the force (F) exerted against the imaging drum 12 by the transfix roller 14. The thicker the media substrate 16, the greater the force (F). When the media 16 engages the transfix nip 18, the angular velocity of the imaging drum 12 is reduced.

The Media Thickness Measurement

When the transfix nip 18 engages the media 16, the thickness of the media determines the amount of additional work the motor has to do to maintain a predetermined speed for the imaging drum 12. As the thickness of the media increases, the amount of work the motor has to do increases. The thickness of the media can be measured using media thickness sensors, which are well-known devices. For example, media thickness can be measured using the OMRON® Z4D-B02 micro displacement sensor, which detects the movement of an idler shaft when sheets pass through. By measuring the media thickness upstream of the nip, it is possible to increase the motor speed when the media is engaged by the nip and maintain the predetermined motor speed. Alternatively, the media thickness could be entered through a user interface by an operator of the printing device.

In order to determine the increased amount of work for the motor caused by media of different thicknesses, an analysis of a prior art system similar to FIG. 1 was conducted to calculate the effect of changes in the thickness of the media substrate 16 to the angular velocity of the imaging drum 12. In the analysis, the media substrate 16 was transported at a velocity (V) and had a thickness (x). The following equations for modeling induced velocity/motion disturbance from sheets entering a nip were used:

Equation (1) calculates the amount of work created by inserting the media substrate into the transfix nip to be equal to the change in kinetic energy.

$$F*x=0.5*I*(\omega_i^2-\omega_f^2) \tag{1}$$

Equation (2) is an approximation for a small velocity change.

$$\omega_f=\omega_i-\Delta\omega \tag{2}$$

Equation (3) only considers the drum inertia based on the weight of the drum ($m=2\pi rLtp$) to determine the change in angular velocity when the media substrate is inserted in the transfix nip.

$$\Delta\omega=-\frac{Fx}{I\omega}=-\frac{Fx}{m\omega r^2}=-\frac{Fx}{\rho 2\pi Ltr3\omega} \tag{3}$$

wherein

| | |
|---|---|
| F | spreader force (N) |
| x | Thickness of media substrate (m) |
| I | moment of inertia (n*n*Imotor + Idrum, n is the gear ratio ($kgm^2$) |
| ω | angular velocity before and after thump (rad/sec) |
| m | Mass of drum (kg) |
| r | drum radius (r) |

-continued

| | |
|---|---|
| t | drum wall thickness (m) |
| ρ | density (kgm$^3$) |

The Transfix Force, i.e., the force applied by the roller 14 to the imaging drum 12 is considered to be a constant, e.g. 20,000 N.

Figure 2:
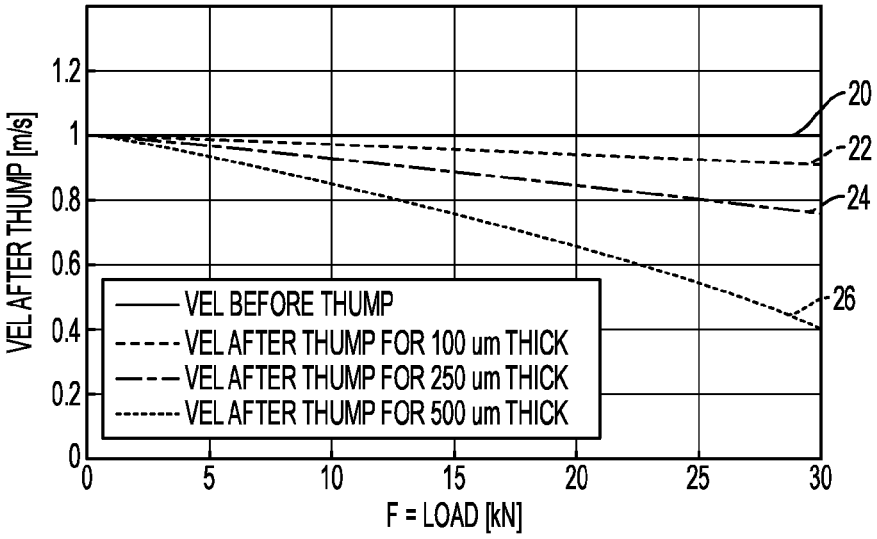
FIG. 2 depicts a graph showing a model of the change in velocity of an imaging drum after media of different thicknesses engage the nip.

Equations (1) to (3) assume that the imaging drum 12 is the primary inertia in the system. They also assume that no external torque is applied (i.e., from a servo) other than the torque disturbance caused by sheet 16 entry into the transfix nip 18. In summary, the load or spreader force (F) (i.e., amount of work done) to separate the imaging drum 12 and transfix roll 14 is equal to the change in kinetic energy (i.e., the velocity of the motor). The effect of media substrate 16 having different thickness on the load/spreader force (F) was calculated using equations (1) to (3) and the results are shown in FIG. 2. A base line velocity 20 of 1 (i.e., 100% velocity) is used for the case when media was not engaging the nip. This graph can be used to create a media thickness torque profile for media of different thicknesses. At a load of 20 kN, a first curve 22 for a media substrate having a thickness of 100 μm is shown to have a drop in angular velocity of about 5%, a second curve 24 for a media substrate having a thickness of 250 μm is shown to have a drop in angular velocity of about 15% and a third curve 26 for a media substrate having a thickness of 500 μm is shown to have a drop in angular velocity of about 35%.

The Media Skew Measurement

When a media substrate (e.g., a sheet) passes into the transfix nip, it increase the load and decreases the velocity of the motor. It has been found that the greatest load increase occurs when the sheet is aligned with the axes of the drum and roller. When the sheet is skewed, the load decreases—the more the sheet is skewed the greater the decrease in the load. Media skew sensors are well-known to those skilled in the art. Media skew can be detected using two point sensors positioned a known distance apart to detect the lead edge of sheets as they pass at a known velocity. If both sensors do not detect the edges passing at the same time, the time differential and the distance between the two sensors can be used to calculate the skew.

Figure 3:
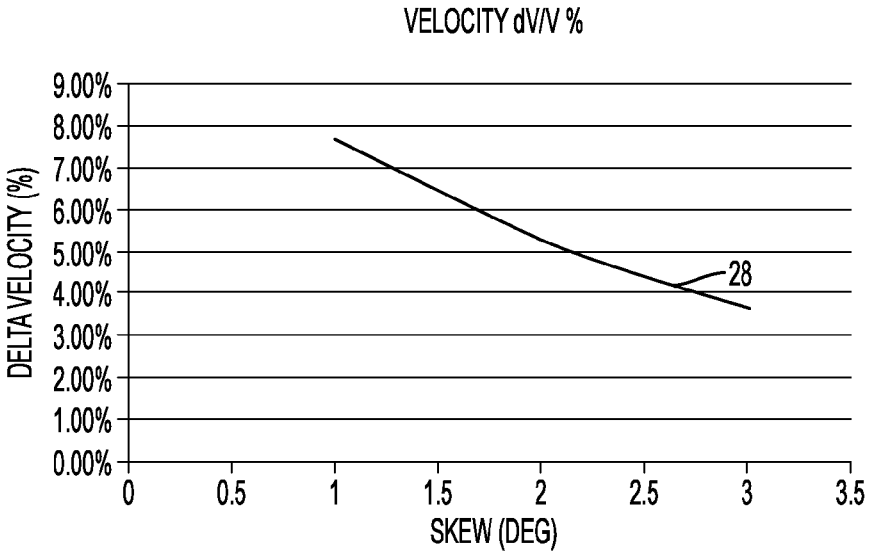
FIG. 3 depicts a graph showing the percent change in velocity of an imaging drum media engaging the nip at various skews.

As a media passes the two skew sensors, the amount of skew (typically measured in degrees) is determined and sent to the motor speed controller. If the media is aligned and there is no skew, the skew measurement is not used to adjust the motor speed. However, if the media is skewed, the applied motor torque is reduced relative to the no skew case to compensate for the skew. The more skewed the media, the more the applied motor torque is reduced relative to the no skew case. In order to quantify the effect of skew on the change in motor velocity, tests were conducted using a drum and roller with sheets of paper fixed to the drum with different skews. The results of the tests were plotted on the graph shown in FIG. 3, which plots the curve 28 for the percentage change in velocity versus the degree of skew. The results show that as the skew increases, the change in velocity decreases. For example, a 1-degree skew causes about a 7.5% change in velocity, while a 3-degree skew causes about a 3.5% change in velocity. This graph can be used to create a media skew torque profile for media engaging the nip at different skews.

Motor Control Using Media Thickness and Skew Measurements

Figure 4:
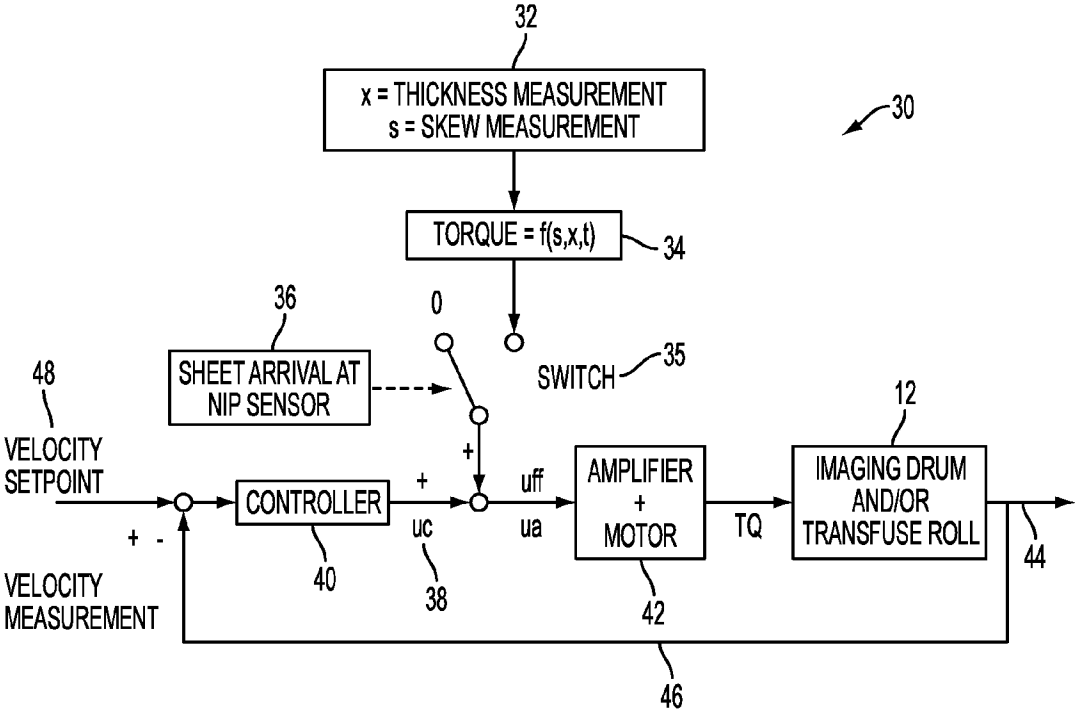
FIG. 4 depicts a control schematic that uses the measured thickness of the media and the measured skew of the media to bias the velocity controller for the imaging drum motor.

Once the media thickness and skew are measured, the motor speed can be controlled to minimize the velocity transient that occurs when the media is engaged by the nip. FIG. 4 shows a control diagram 30 in which the thickness and skew measurements 32 are used to increase the motor torque 34 when the nip sensor 36 detects the arrival of the media actuates an on-off switch 35. The increase in motor torque 34 is calculated to compensate for the velocity transient caused by the media and is added to the output signal 38 from the controller 40. The combined controller output signal 38 and increase in motor velocity 34 is sent to the motor 42 that rotates the imaging drum 12. A speed sensor 44 measures the angular velocity of the imaging drum 12 and sends an output signal 46 to adjust the controller set point signal 48. For example, a thicker media would cause a greater velocity transient and require a greater increase in motor torque. Similarly, the more skewed the media the less the increase in motor torque. If the media was not skewed, only the media thickness measurement would be used to adjust the motor torque.

The conventional servo control consists of a controller acting on a velocity error (setpoint-measurement) producing a control signal uc (=ua) to an amplifier+motor to generate a torque TQ to control the velocity. The present system uses a torque profile (Torque) generated as a function of the media thickness measurement x and a skew profile generated as a function of the skew measurement s. Upon arrival of the media in the nip, the feedfoward control signal is switched (from 0) to the output signal generated by the torque and skew profiles (uff). The control signal to the amplifier is then the sum of the controller output signal and the torque/skew output signal (ua=uc+uff). This feedforward scheme allows the motor to generate the additional torque necessary to reduce the velocity transient when the media is engaged by the nip.

Figure 5:
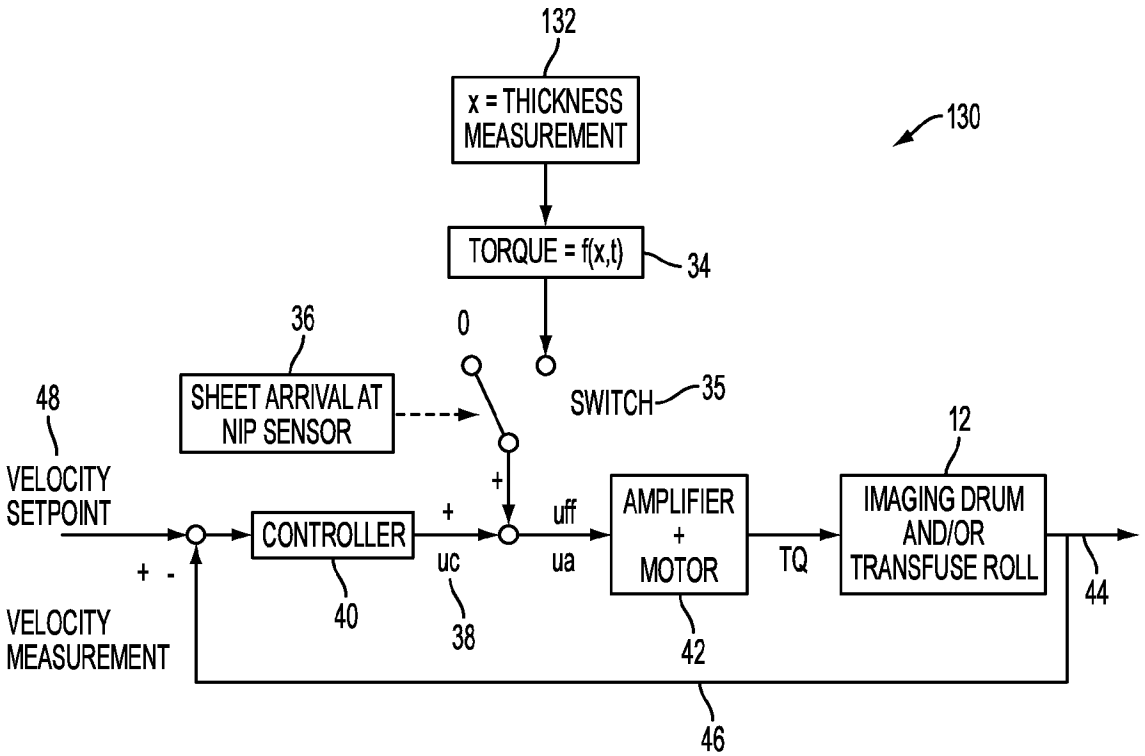
FIG. 5 depicts a control schematic that uses the measured thickness of the media to bias the velocity controller for the imaging drum motor.
Figure 6:
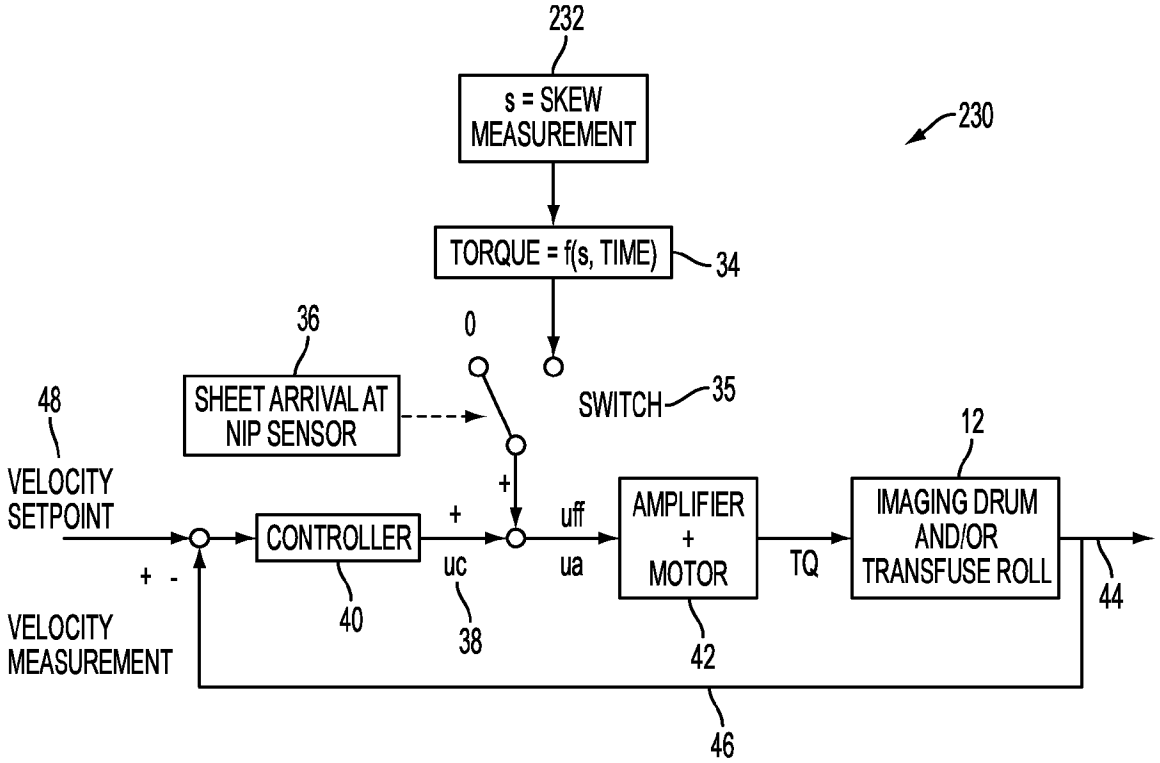
FIG. 6 depicts a control schematic that uses the measured skew of the media to bias the velocity controller for the imaging drum motor.

In a similar manner as the controls that utilize the media thickness and media skew, the two measurements can be used individually in a control scheme. FIGS. 5 and 6 show control diagrams 130 and 230 in which the media thickness measurement 132 and media skew measurement 232, respectively, are used separately to increase the motor velocity 34 when the nip sensor 36 detects the arrival of the media.

EXAMPLES

Example 1

Figure 7:
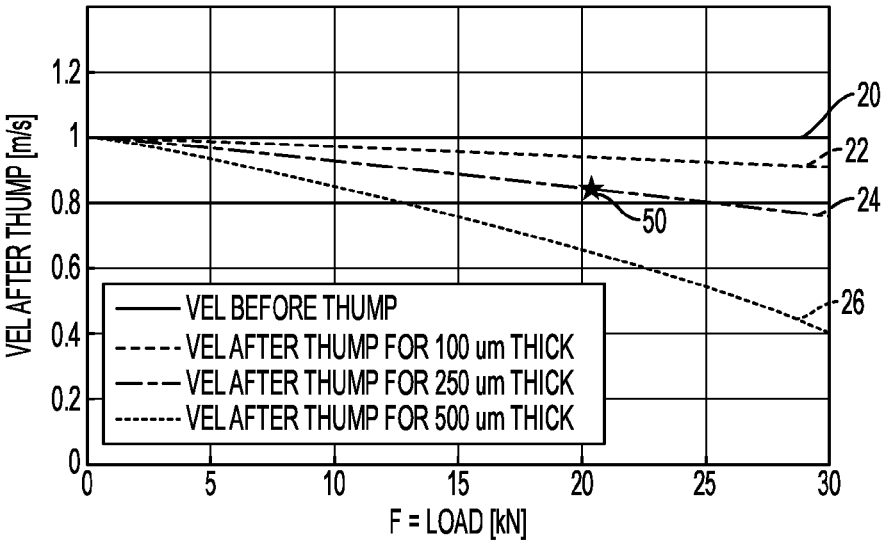
FIG. 7 depicts a graph showing a model of the change in velocity of an imaging drum after media of 250 μm thickness engages the nip at 20,000 N.

A test was conducted using an imaging drum 12 and transfix roller 14 similar to the system shown in FIG. 1. The imaging drum 12 was 17 inches long with a diameter of 21.75 inches and a wall thickness of 0.75 inch. The moment of inertia of the drum was about 2.6 kgm$^2$. For the test, the drum rotated with a surface velocity of 1 m/s. At a load (i.e., a transfix force, F) of 20,000 N, the test measured a drop in motor velocity of about 15% when sheets were fed into the transfix nip (star in FIG. 7). The graph in FIG. 7 also shows the curves 20, 22, 24, 26 from FIG. 2 for the calculated change in motor velocity when sheets having thicknesses of 100 μm, 250 μm and 500 μm are fed into the nip 18. The results from the test as indicated by the star in FIG. 7 are substantially the same as the curves generated using equations (1) to (3) and show that the torque applied to the motor controlling the imaging drum and/or transfer roll is a function of the measurement of media thickness (x) and time (t).

Example 2

The system and method were verified on a Phaser 8500 series printer. The imaging drum was driven by a dc motor through about 10:1 gear ratio belt. An encoder on the drum measured the angular velocity of the drum and, when multiplied by the drum radius, the surface velocity of the drum. The transfix roll was a passive (i.e. no drive motor was attached) hard rubber roll that was driven by tangential interface forces. The transfix roll was loaded with springs onto the imaging drum and it was always engaged during the tests. A sheet of paper was taped onto the drum to simulate sheets being fed from a paper path. The signal from a sheet sensor wad mounted just ahead of the drum/transfix interface was used to determine the time of arrival of the sheet at the interface. For this experiment, one media thickness (250 μm) was used.

Figure 8:
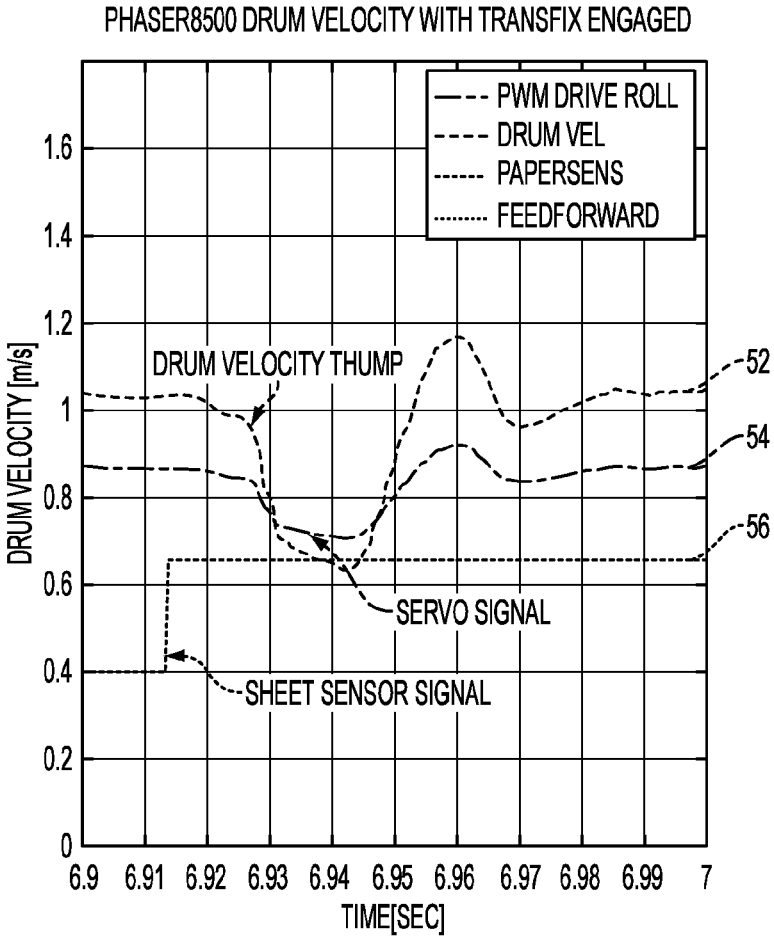
FIG. 8 depicts a graph showing the drum velocity thump, the servo signal and the sheet sensor signal without feedforward control.
Figure 9:
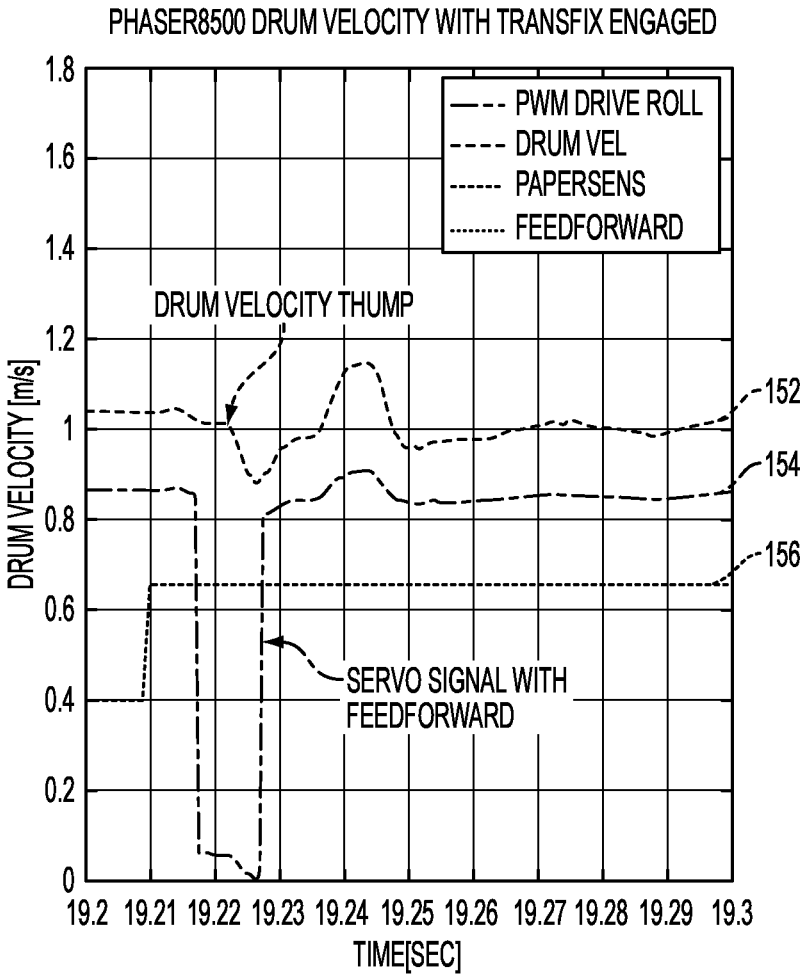
FIG. 9 depicts a graph showing the drum velocity thump, the servo signal and the sheet sensor signal with feedforward control using the thickness of the media to bias the velocity of the imaging drum motor.

FIGS. 8 and 9 compare the velocity/motion disturbance without feedforward (FIG. 8) and with feedforward (FIG. 9). The figures show the before and after drum velocity curve 52,152, the servo signal curve 54, 154, and the sheet sensor signal curve 56, 156. The figures show that, without feedforward, the angular velocity curve of the drum has a maximum deviation of about 0.4 m/sec. (from about 1.03 m/sec to about 0.63 m/sec). With feedforward, the angular velocity of the drum has a maximum deviation of about 0.13 m/sec. (from about 1.03 m/sec to about 0.9 m/sec). Thus, the test showed the improvement is a factor of about 3 (0.4v m/sec. without feedforward versus 0.13 m/sec. with feedforward).

It will be appreciated that various embodiments of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A system for reducing velocity transits in a printing system caused by media entering into a transfer nip, the system comprising:

an imaging drum rotating about a longitudinal axis and having a drum surface equidistant from the longitudinal axis;

a variable speed motor for rotating the imaging drum at an angular velocity;

a transfix roll rotating about a longitudinal axis at an angular velocity and having a roll surface equidistant from the longitudinal axis, wherein the longitudinal axis of the drum is substantially parallel to the longitudinal axis of the roll and the drum surface contacts the roll surface;

a transfix nip formed where the imaging drum contacts the transfix roll, wherein media entering into the transfix nip causes a velocity transient in the angular velocity;

a media transport for moving a media along a media path in a process direction, wherein the media is transported to the transfix nip;

a means for determining the thickness of the media and transmitting a thickness output signal;

a skew sensor for measuring the skew of the media and transmitting a skew output signal; and a controller having a motor speed set point and an output signal for controlling the variable speed motor at the motor speed set point, wherein the output signal is adjusted based on the thickness output signal and the skew output signal.

2. The system for reducing velocity transits according to claim 1, further comprising a media sensor for detecting media entering into the transfix nip.

3. The system for reducing velocity transits according to claim 2 further comprising an electronic switching control means having an on state and an off state, wherein, when the switch is in the on state, the thickness and skew output signals adjust the controller output signal, and wherein, when the switch is in the off state, the thickness and skew output signals do not adjust the controller output signal.

4. The system for reducing velocity transits according to claim 1, wherein the thickness signal is compared to a media thickness torque profile for media of different thicknesses.

5. The system for reducing velocity transits according to claim 1, wherein the skew signal is compared to a media skew torque profile for media of different skews.

6. The system for reducing velocity transits according to claim 1, wherein the variable speed motor comprises a speed sensor for measuring the angular velocity and transmitting a motor speed output signal, and wherein the motor torque is adjusted based on the motor speed output signal.

7. The system for reducing velocity transits according to claim 1, wherein the adjustment of the controller output based on the thickness output signal and the skew output signal maintains the angular velocity of the drum at the motor speed set point when the thickness of the media changes.

8. The system for reducing velocity transits according to claim 1 further comprising a media thickness torque profile for media of different thicknesses and a media skew torque profile for media of different skews, wherein the thickness output signal is compared to the media thickness torque profile to provide a media thickness torque value and the skew output signal is compared to the media skew torque profile to provide a media skew torque value, and wherein the media thickness torque value and the media skew torque value are used to calculate a torque compensation signal for the variable speed motor.

9. The system for reducing velocity transits according to claim 8, wherein the velocity transient compensation is equal to within +/−10% of the velocity transient in the angular velocity.

10. The system for reducing velocity transits according to claim 1, wherein the transfix nip can receive media having a thickness of from 50 μm to 2 mm.

11. A system for reducing velocity transits in a printing system caused by media entering into a transfer nip, the system comprising:

an imaging drum rotating about a longitudinal axis and having a drum surface equidistant from the longitudinal axis;

a variable speed motor for rotating the imaging drum at an angular velocity;

a transfix roll rotating about a longitudinal axis at an angular velocity and having a roll surface equidistant from the longitudinal axis, wherein the longitudinal axis of the drum is parallel to the longitudinal axis of the roll and the drum surface contacts the roll surface;

a transfix nip formed where the imaging drum contacts the transfix roll, wherein media entering into the transfix nip causes a velocity transient in the angular velocity;

a media transport for moving a media along a media path in a process direction, wherein the media is transported to the transfix nip;

a media sensor for detecting media entering into the transfix nip;

a means for detecting the thickness of the media and transmitting a thickness output signal;

a skew sensor for measuring the skew of the media and transmitting a skew output signal;

a controller having a motor speed set point and an output signal for controlling the variable speed motor at the motor speed set point; and an electronic switching control means having an on state and an off state, wherein, when the switch is in the on state, the thickness and skew output signals adjust the controller output signal, and wherein, when the switch is in the off state, the thickness and skew output signals do not adjust the controller output signal wherein the controller output signal is adjusted based on the thickness output signal and the skew output signal.

12. The system for reducing velocity transits according to claim 11, wherein the variable speed motor comprises a speed sensor for measuring the angular velocity and transmitting a motor speed output signal, and wherein the motor speed set point is adjusted based on the motor speed output signal.

13. The system for reducing velocity transits according to claim 11 further comprising a media thickness torque profile for media of different thicknesses and a media skew torque profile for media of different skews, wherein the thickness output signal is compared to the media thickness torque profile to provide a media thickness torque value and the skew output signal is compared to the media skew torque profile to provide a media skew torque value, and wherein the media thickness torque value and the media skew torque value are used to calculate a torque compensation signal to increase the seed of the variable speed motor.

14. The system for reducing velocity transits according to claim 11, wherein the angular velocity adjustment by the thickness output signal and the skew output signal is within +/−10% of the velocity transient in the angular velocity.

15. The system for reducing velocity transits according to claim 11, wherein the adjustment of the angular velocity of the imaging drum based on the thickness output signal and the skew output signal maintains the angular velocity of the drum at the motor speed set point when the thickness of the media changes.

16. The system for reducing velocity transits according to claim 11, wherein the transfix nip can receive media having a thickness of from 50 μm to 2 mm.

17. The system for reducing velocity transits according to claim 11, wherein the velocity transient compensation signal is within +/−10% of the velocity transient in the angular velocity.

18. The system for reducing velocity transits according to claim 11, wherein the transfix nip can receive media having a thickness of from 50 μm to 2 mm.

19. A system for reducing velocity transits in a printing system caused by media entering into a transfer nip, the system comprising:

an imaging drum rotating about a longitudinal axis and having a drum surface equidistant from the longitudinal axis;

a variable speed motor for rotating the imaging drum at an angular velocity;

a transfix roll rotating about a longitudinal axis at an angular velocity and having a roll surface equidistant from the longitudinal axis, wherein the longitudinal axis of the drum is parallel to the longitudinal axis of the roll and the drum surface contacts the roll surface;

a transfix nip formed where the imaging drum contacts the transfix roll, wherein media entering into the transfix nip causes a velocity transient in the angular velocity;

a media transport for moving a media along a media path in a process direction, wherein the media is transported to the transfix nip;

a media sensor for detecting media entering into the transfix nip;

a means for detecting the thickness of the media and transmitting a thickness output signal;

a skew sensor for measuring the skew of the media and transmitting a skew output signal;

a speed sensor for measuring the speed of the variable speed motor and transmitting a motor speed output signal;

a controller having a motor speed set point and an output signal for controlling the variable speed motor at the motor speed set point;

a media thickness torque profile for media of different thicknesses, wherein the thickness output signal is compared to the media thickness torque profile to provide a media thickness torque value;

a media skew torque profile for media of different skews, wherein the skew output signal is compared to the media skew torque profile to provide a media skew torque value; and an electronic switching control means having an on state and an off state, wherein, when the switch is in the on state, the thickness and skew output signals adjust the controller output signal, and wherein, when the switch is in the off state, the thickness and skew output signals do not adjust the controller output signal;

wherein the media thickness torque value and the media skew torque value are used to calculate a velocity transient compensation signal to increase the seed of the variable speed motor.

20. The system for reducing velocity transits according to claim 19, wherein the motor speed set point is adjusted based on the motor speed output signal.

* * * * *